US005421744A

United States Patent [19]

Hio

[11] Patent Number: 5,421,744

[45] Date of Patent: Jun. 6, 1995

[54] SHIELD CONNECTOR

[75] Inventor: Masahide Hio, Yokkaichi, Japan

[73] Assignee: Sumitomo Wiring Systems, Ltd., Mie, Japan

[21] Appl. No.: 183,967

[22] Filed: Jan. 21, 1994

[30] Foreign Application Priority Data

Jan. 27, 1993 [JP] Japan ..... 5-032756

[51] Int. Cl.[6] ..... H01R 13/436

[52] U.S. Cl. ..... 439/595; 439/610

[58] Field of Search ..... 439/595, 607, 610

[56] References Cited

U.S. PATENT DOCUMENTS 4,602,836 7/1986 Garretson et al. ..... 439/595

5,002,504 3/1991 Carlson ..... 439/595

*Primary Examiner*—Gary F. Paumen

*Attorney, Agent, or Firm*—Oliff & Berridge

[57] ABSTRACT

When operating a shield connector, if a metal terminal is inserted into a proper position, the metal terminal is prevented by a first withdrawal prevention device from withdrawal. When a housing and a shield cover are connected together, the metal terminal is further prevented by a second withdrawal prevention device from withdrawal. If the metal terminal is not inserted into the proper position, a resilient retaining pawl of the second withdrawal prevention device engages an engagement portion of the metal terminal to be prevented from resilient deformation when the housing and the shield cover are to be connected together. As a result, the shield cover engages an engagement projection of the resilient retaining pawl, so that the housing and the shield cover cannot be connected together.

15 Claims, 8 Drawing Sheets

SHIELD CONNECTOR

BACKGROUND OF THE INVENTION

This invention relates to a shield connector of the type in which a shield cover is fitted on a connector housing and more particularly to a shield cover including a double-lock structure for preventing withdrawal of the terminal and structure enabling detection of an incomplete insertion.

One known shield connector of this type comprises an insulative connector housing having terminal receiving chambers into which metal terminals connected respectively to core wires of a shield wire are respectively inserted from rear ends of these chambers. The shield connector also includes an electrically-conductive shield cover fitted on the connector housing and electrically connected to a shield conductor of the shield wire when the shield cover is fitted on the connector housing.

In such a shield connector, the following two constructions have heretofore been commonly used as retaining devices for attaching the metal terminals to the connector housing in a manner to prevent the metal terminals from withdrawal.

A first construction is a so-called single lock construction, in which resilient retaining pawls are formed on the connector housing or the metal terminals, and when the metal terminal is inserted into a predetermined position within the terminal receiving chamber of the connector housing, the resilient pawl performs its retaining function.

With this construction, however, the metal terminal is retained only at one portion, and therefore the withdrawal prevention force is inferior. Furthermore, if the metal terminal is not inserted into the proper position within the terminal receiving chamber, the resilient retaining pawl may exhibit a weak retaining force to hold the metal terminal in a provisionally-retained condition. In such a condition, the operator is liable to misunderstand that complete insertion has been made, resulting in a problem that a defect such as withdrawal of the metal terminal arises after the connection of the connector.

A second construction called a double lock construction has been proposed. In this construction, there is provided a retainer for insertion into the connector housing. The retainer is first inserted into a provisionally-retained position, and the metal terminal is inserted into the connector housing from a rear end thereof, so that the resilient retaining pawl retains the metal terminal against withdrawal. Thereafter, the retainer is farther pushed from the provisionally-retained position, so that a retaining projection formed on the retainer is engaged with the metal terminal, thereby completely holding the metal terminal against movement in its withdrawing direction.

In this construction, the metal terminal is retained at two portions by the resilient retaining pawl of the connector housing and the retaining projection of the retainer, and therefore a strong withdrawal prevention force can be obtained. If the metal terminal is not inserted into the proper position within the terminal receiving chamber, the retainer cannot be further pushed from the provisionally-retained position, and therefore the incompletely inserted condition can be detected, thus achieving an effect of preventing a defect (i.e., terminal withdrawal) from arising.

In the above double lock method, however, in addition to the connector housing, the separate part, that is, the retainer, is needed. Particularly in the case where the shield connector is of the type including, in addition to the metal terminals and the connector housing, a shield cover for fitting on the connector housing, there is encountered a drawback that the number of parts is considerably increased.

SUMMARY OF THE INVENTION

The present invention has been made under the above circumstances, and therefore an object of the invention is to provide a shield connector that has a metal terminal withdrawal prevention function and an incomplete metal terminal insertion-detecting function, which functions are equivalent to those of a double lock-type connector, without increasing the number of component parts.

This and other objects are achieved by providing a first retaining device that is engaged with a metal terminal inserted into a predetermined position within a terminal receiving chamber of a connector housing, thereby preventing the movement of the metal terminal in a withdrawing direction. A second retaining device is engageable with the metal terminal when the metal terminal reaches the predetermined position and prevents the movement of the metal terminal in the withdrawing direction when the second retaining device engages the metal terminal. The second retaining device engages the metal terminal when the shield cover is fitted on the connector housing.

The second retaining device may include a resilient retaining portion resiliently, deformably mounted on the connector housing, wherein when the shield cover is fitted on the connector housing, the resilient retaining portion is deformed by the shield cover into engagement with the metal terminal inserted into the predetermined position.

The second retaining device may further include a retaining portion mounted on the shield cover, wherein when the shield cover is fitted on the connector housing, the retaining portion is brought into engagement with the metal terminal inserted into the predetermined position.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

A first preferred embodiment of the present invention will now be described with reference to FIGS. 1 to 7.

Figure 1:
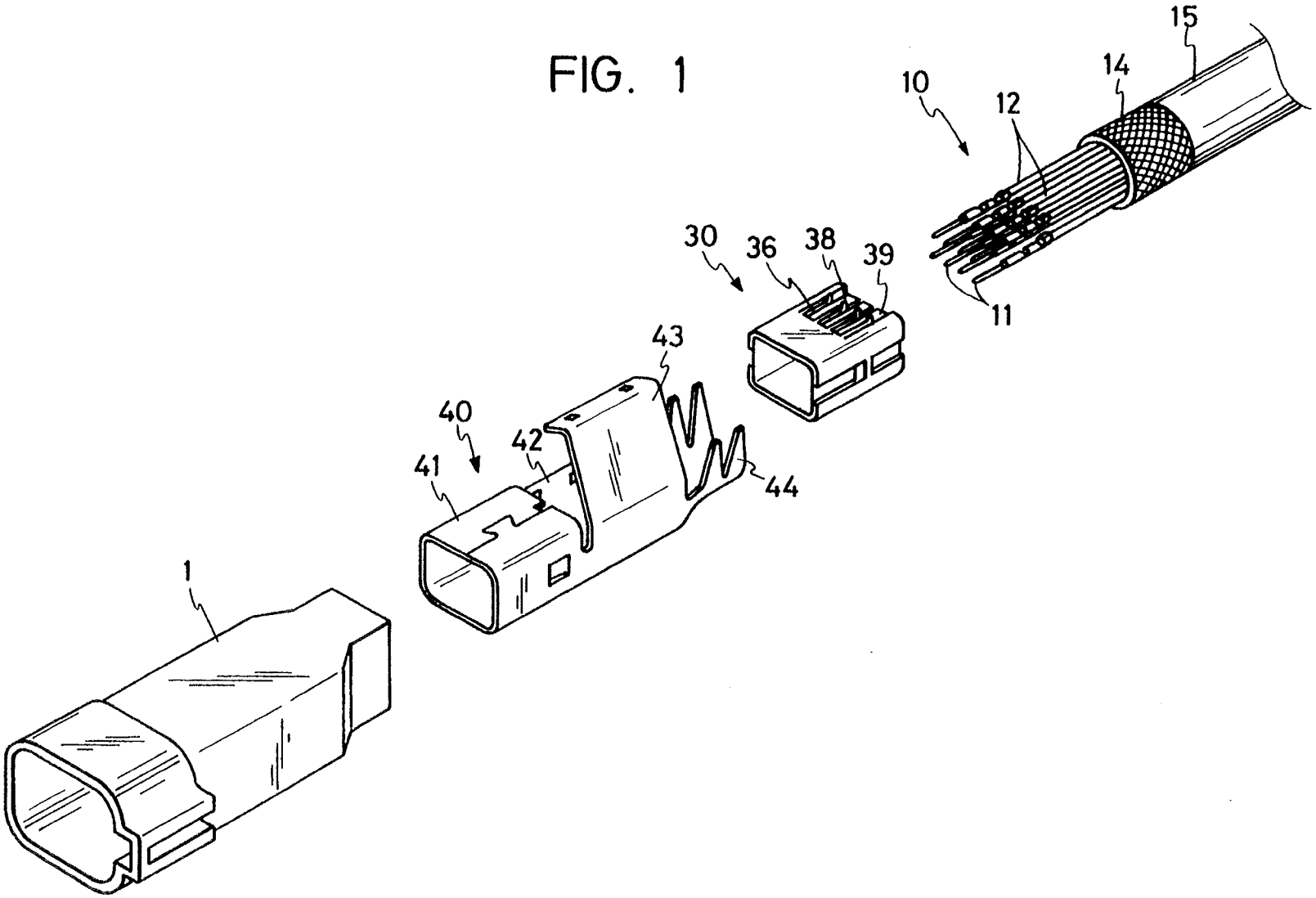
FIG. 1 is an exploded, perspective view of a first embodiment.
Figure 2:
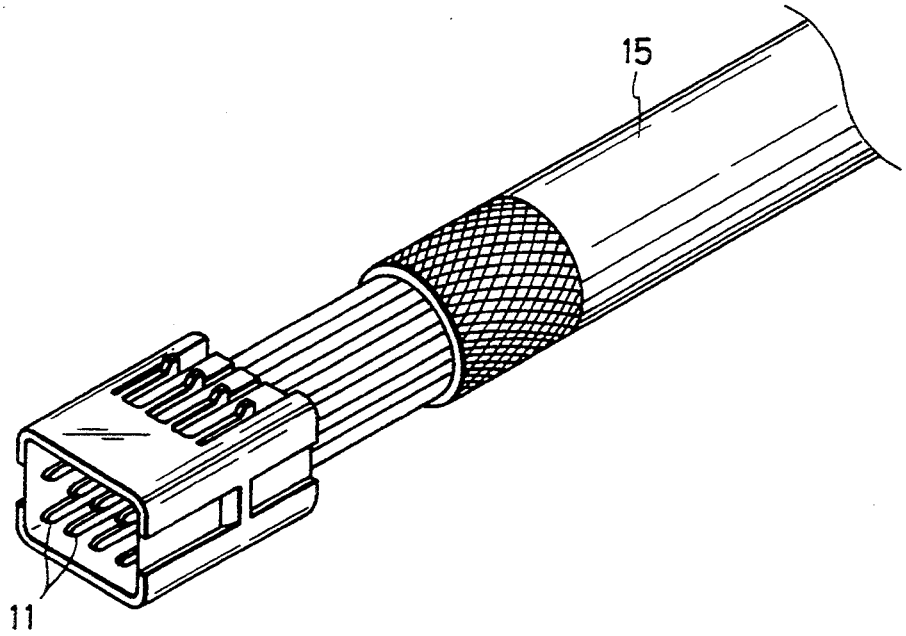
FIG. 2 is a perspective view showing a shield wire having a connector housing connected thereto.
Figure 3:
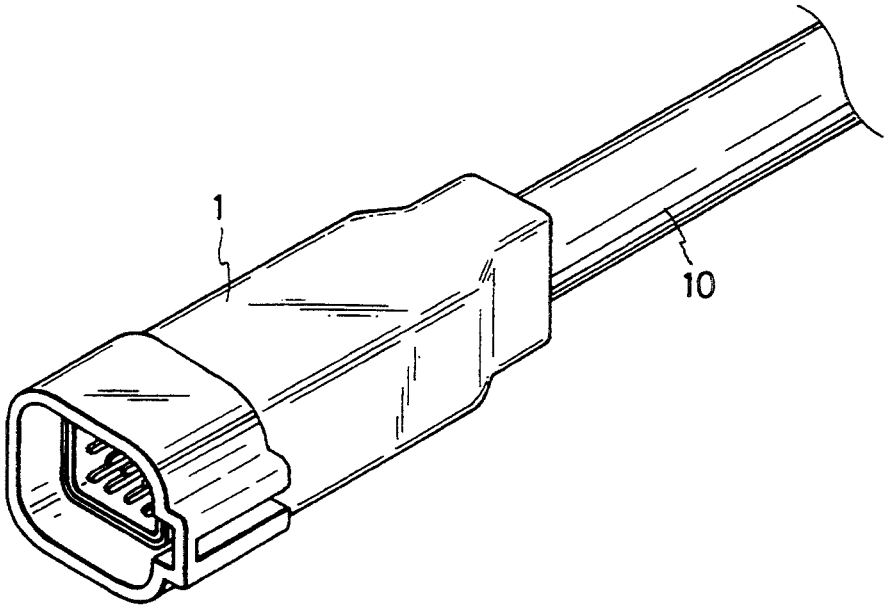
FIG. 3 is a perspective view of a shield connector in its assembled condition.
Figure 4:
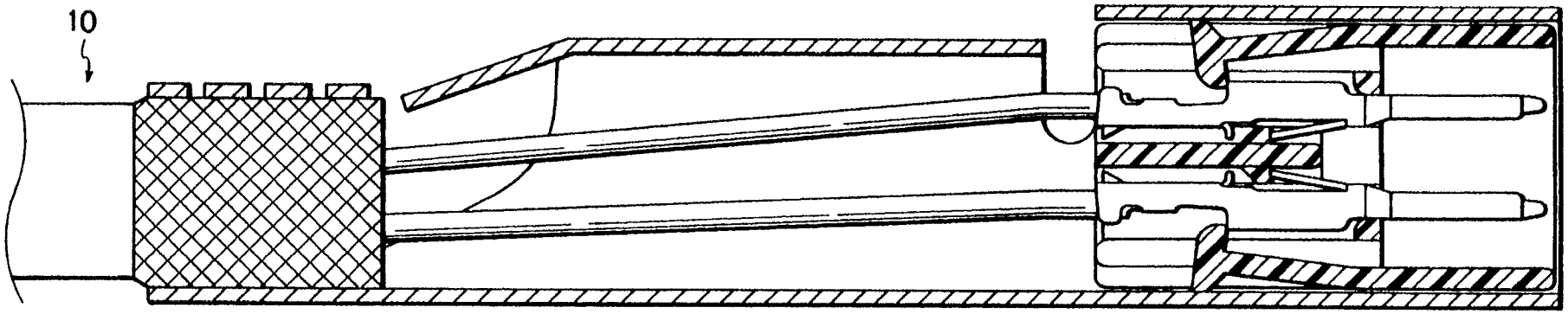
FIG. 4 is a cross-sectional view of the shield connector in the assembled condition.

As shown in FIG. 1, as a whole, the construction comprises a tubular insulative cover 1, a shield wire 10, an insulative connector housing 30, and an electrically-conductive shield cover 40. The connector housing 30 is attached to a front end of the shield wire 10 as shown in FIG. 2. The shield cover 40 is fitted on the connector housing 30, and the insulative cover 1 is fitted on the shield cover 40. This assembled condition is shown in FIG. 3.

The shield wire 10 is of a conventional construction, and comprises a bundle, for example, of eight core wires 12, a mesh-like shield conductor 14 covering an outer periphery of the bundle through an insulative cover, and an insulative sheath 15 covering the shield conductor 14. A metal terminal 11 is fixedly secured to a front end of each core wire 12.

Figure 5:
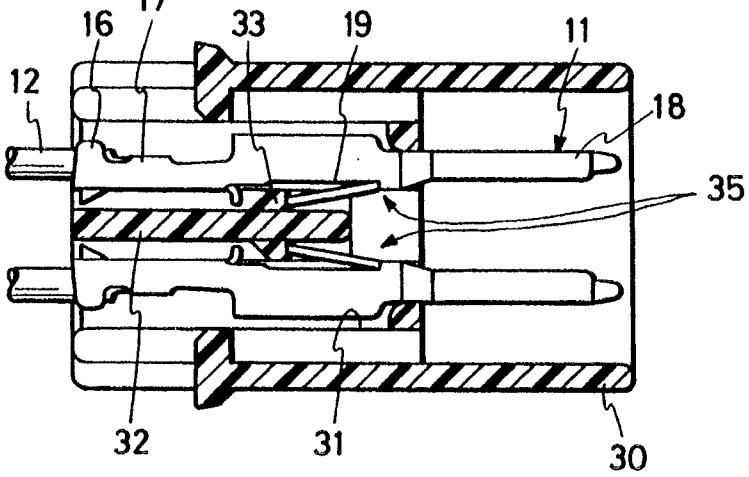
FIG. 5 is a cross-sectional view showing a condition in which a connector housing is attached to the shield wire.
Figure 6:
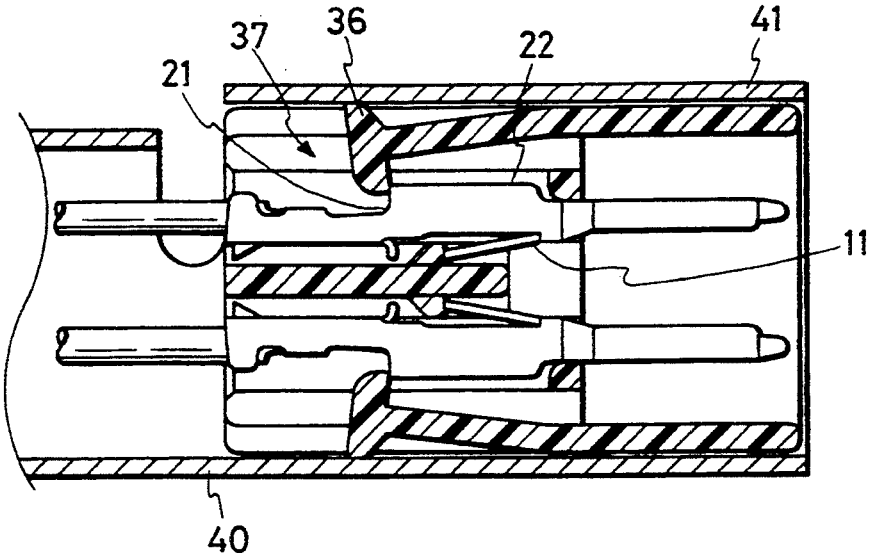
FIG. 6 is a cross-sectional view showing a condition in which metal terminals inserted into respective predetermined positions are retained by first and second retaining devices against withdrawal.
Figure 7:
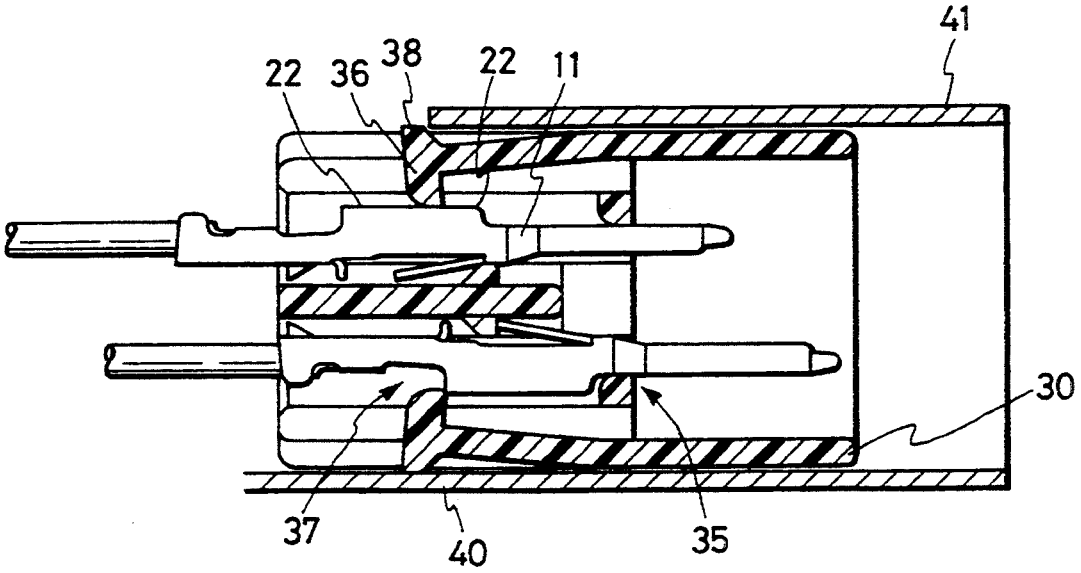
FIG. 7 is a cross-sectional view showing a condition in which the fact that the metal terminal has not been inserted into the predetermined position is detected when a shield cover is to be attached to the connector housing.

Referring to FIGS. 5–7, the metal terminal 11 is an elongate, tubular male terminal, and has at its rear portion an insulation barrel 16 compressively clamped to a cover of the core wire 12, a wire barrel 17 compressively clamped to a conductor of the core wire 12, and a contact portion 18 at its front end portion. The metal terminal 11 has a resilient retaining piece 19 that is formed by stamping and raising part of the metal terminal, the retaining piece 19 extending obliquely rearwardly. A retaining portion 21 is formed on that portion of the metal terminal 11 facing away from the resilient retaining piece 19 and extends perpendicular to the direction of the length of the metal terminal 11, the retaining portion 21 facing rearwardly. An outer surface of retaining portion 21 extending forwardly from the retaining portion 21 serves as an engagement portion 22 extending parallel to the direction of the length of the metal terminal 11.

The connector housing will now be described with reference to FIGS. 5–7. The connector housing 30 is of a tubular shape having a square cross-section and has eight terminal receiving chambers 31 for respectively receiving the metal terminals 11 of the shield wire 10. An upper row of four juxtaposed chambers 31 and a lower row of four juxtaposed chambers 31 are arranged in pairs. A retaining projection 33 is provided in each terminal receiving chamber 31, projecting from a partition wall 32 dividing each pair of terminal receiving chambers 31 from each other. Retaining projection 33 cooperates with the resilient retaining piece 19 of the metal terminal 11 of the shield wire 10 to form a first retaining means 35. When the metal terminal 11 is inserted into a predetermined position within the terminal receiving chamber 31, a rear end of the resilient retaining piece 19 is retained by a front face of the retaining projection 33.

The connector housing 30 has four juxtaposed elongate resilient retaining portions (resilient retaining pawls) 36 provided at each of upper and lower walls that isolate the terminal receiving chambers 31 from the outer surface of the connector housing. Each of the resilient retaining pawls 36 extends rearwardly from a generally central portion of the upper or the lower wall and is bent at its distal end portion to project into the terminal receiving chamber 31. The resilient retaining pawls 36 are provided in corresponding relation to the terminal receiving chambers 31, respectively. The resilient retaining pawl 36 cooperates with the retaining portion 21 and the engagement portion 22 of the metal terminal 11 to form a second retaining means 37.

A projection 38 is formed on an outer surface of the distal end of each resilient retaining pawl 36. Projection 38 projects beyond the upper or the lower surface of the connector housing 30, respectively when the resilient retaining pawl 36 is not resiliently deformed. A non-deformable portion 39, extending parallel to the resilient retaining pawls 36 is formed between any two adjacent ones of the row of four juxtaposed resilient retaining pawls 36. Thus, three non-deformable portions 39 are provided at each of the upper and lower walls.

When the resilient retaining pawl 36 is in a free condition, that is, not resiliently deformed, pawl 36 is disposed out of a path of insertion of the metal terminal 11 into the terminal receiving chamber 31, and therefore, pawl 36 does not inhibit the insertion of the metal terminal. When the resilient retaining pawl 36 is resiliently deformed to such an extent that the projection 38 on the outer surface of the distal end of pawl 36 does not project outwardly beyond the outer surface of the connector housing 30, the resilient retaining pawl 36 retainingly engages the retaining portion 21 of the metal terminal 11, inserted into the predetermined position within the terminal receiving chamber 31, from the rear side.

When the metal terminal 11 is not fully inserted into the predetermined position within the terminal receiving chamber 31, the resilient retaining pawl 36 is slightly resiliently deformed to engage the engagement portion 22 of the metal terminal 11, and is prevented from being further deformed resiliently. In this further deformation-prevented condition, the projection 38 on the outer surface of the distal end is projected beyond the outer surface of the connector housing 30.

The shield cover 40 is formed by bending an electrically-conductive metal plate into a tubular shape. The shield cover 40 has a front end portion defining a fitting portion 41 for intimately fitting on the outer surface of the connector housing 30, a central portion defining an insertion portion 42 with an upwardly-openable lid 43, and a rear end portion defining a connection portion 44 for embracing the shield conductor 14 of the shield wire 10 to be electrically connected thereto.

The lid 43 of the central portion of the shield cover 40 is opened, and the connector housing 30 is inserted into the insertion portion 42. The connector housing 30 is moved forwardly relative to the shield cover to be pushed into the fitting portion 41, and the connection portion 44 at the rear end portion is deformed to clamp the shield conductor 14. Thus, the shield cover 40 is attached to the shield wire 10 and the connector housing 30. As the connector housing 30 is pushed into the fitting portion 41 of the shield cover 40, the resilient retaining pawls 36 are inwardly urged and deformed resiliently. When the resilient retaining pawls 36 are inhibited from resilient deformation, with the projections 38 on their distal ends projected beyond the outer surface of the connector housing 30, the projections 38 abut against a rear edge of the fitting portion 41, so that the pushing of the connector housing 30 into the fitting portion 41 is prevented. After attaching the shield cover 40, the insulative cover 1 is moved forwardly to cover the connector housing and the shield cover 40.

The procedure of assembling the shield connector of this embodiment will now be described.

For connecting the connector housing 30 to the shield wire 10, the metal terminals 11 are first inserted into the terminal receiving chambers 31 of the connector housing 30, respectively. As each metal terminal 11 is inserted, the resilient retaining piece 19 of the metal terminal 11 constituting the first retaining means 35 abuts against the tip of the retaining projection 33. Simultaneously, when the metal terminal 11 is inserted into the predetermined position, the resilient retaining piece 19 of the metal terminal 11 is restored to be retained by the front face of the retaining projection 33, as shown in FIG. 5. As a result, the movement of the metal terminal 11 in a rearward direction, that is, in a withdrawing direction, is prevented.

Thereafter, the connector housing 30 is pushed into the fitting portion 41 of the shield cover 40. At this time, the projection 38 on the outer surface of the distal end of each resilient retaining pawl 36 is urged by the inner surface of the fitting portion 41, so that the resilient retaining pawl 36 is resiliently deformed obliquely inwardly to engage the retaining portion 21 of the metal terminal 11 from the rear side, as shown in FIG. 6. As a result, the movement of the metal terminal 11 in the rearward direction, that is, in the withdrawing direction, is prevented, thus achieving the withdrawal prevention function of the second retaining means 37.

Thus, when the metal terminal 11 has been inserted into the proper position, the withdrawal of the metal terminal 11 is prevented in a double manner by the first retaining means 35 and the second retaining means 37, thereby positively preventing the withdrawal of the metal terminal 11.

If the metal terminal 11 is not fully inserted into the predetermined position within the terminal receiving chamber 31, that is, in an incompletely inserted condition, the distal end of the resilient retaining pawl 36 faces the engagement portion 22 of the metal terminal 11 when the shield wire 10 and the connector housing 30 are connected together.

Therefore, when the connector housing 30 is to be pushed into the fitting portion 41 so as to connect the connector housing 30 to the shield cover 40, the projection 38 of the resilient retaining pawl 36 is urged by the rear edge of the fitting portion 41, so that the resilient retaining pawl 36 is slightly resiliently deformed into engagement with the engagement portion 22 of the metal terminal 11, and therefore, retaining pawl 36 is prevented from further resilient deformation. In this condition, the projection 38 of the resilient retaining pawl 36 is engaged with the rear edge of the fitting portion 41 of the shield cover 40 as shown in FIG. 7, and therefore the connector housing 30 cannot be pushed farther into the fitting portion 41.

Thus, if the metal terminal 11 is not fully inserted into the proper position, the operation of connecting the connector housing 30 and the shield cover 40 together cannot be effected, and the fact that the metal terminal 11 is incompletely inserted in the terminal receiving chamber 31 can be detected.

Modifications of the connector housing will now be described with reference to FIGS. 8 to 11.

Figure 8:
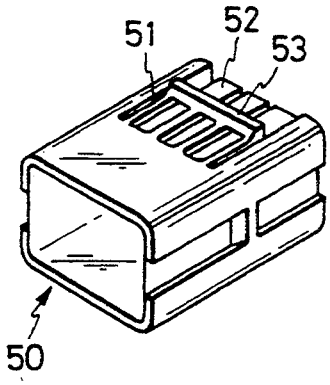
FIG. 8 is a perspective view of a modification of the connector housing of the first embodiment.

A connector housing 50 shown in FIG. 8, like the connector housing 30 of the first embodiment, has four resilient retaining pawls 51 on each of upper and lower sides thereof, and three non-deformable portions 52 on each of the upper and lower sides, which non-deformable portion 52 is provided between any two adjacent ones of the resilient retaining pawls 51.

A projection 53 is formed on outer surfaces of distal ends of the resilient retaining pawls 51. Projection 53 is urged when a shield cover (not shown) is fitted on the connector housing 50. The projection 53 is of an integral configuration and transversely interconnects the distal ends of the four resilient retaining pawls 51 on each of the upper and lower sides. The projection 53 is spaced from outer surfaces of the non-deformable portions 52 when the resilient retaining pawls 51 are in a free condition, that is, not resiliently deformed, and with this arrangement, the resilient retaining pawls 51 can be resiliently deformed without interference with the non-deformable portions 52.

Figure 9:
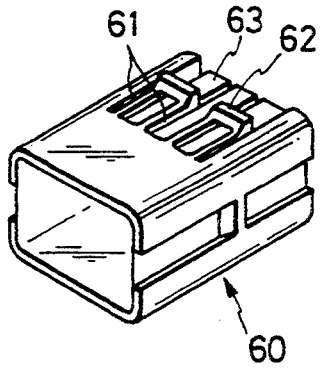
FIG. 9 is a perspective view of a modification of the connector housing of the first embodiment.

In a connector housing 60 shown in FIG. 9, there are provided integral projections 62 each of which interconnects respective two adjacent ones of four resilient retaining pawls 61. The projection 62 is spaced from non-deformable portions 63 when the resilient retaining pawls 61 are not resiliently deformed, so that the resilient retaining pawls 61 can be resiliently deformed.

Figure 10:
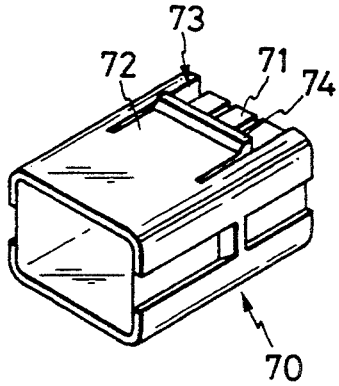
FIG. 10 is a perspective view of a modification of the connector housing of the first embodiment.

In a connector housing 70 shown in FIG. 10, a plate-like portion 72 extends in spaced relation to outer surfaces of three non-deformable portions 71 on each of upper and lower sides of the connector housing. Four pawls (not shown) for respectively retainingly engaging retaining portions of metal terminals (not shown in FIG. 10) project inwardly from an inner surface of the plate-like portion 72 at a distal end thereof without interference with the non-deformable portions 71, this construction constituting a resilient retaining portion 73. An engagement projection 74 in the form of an elongate ridge is formed on an outer surface of the resilient retaining portion 73 at a distal end thereof, and extends perpendicular to the plate-like portion 72.

Figure 11:
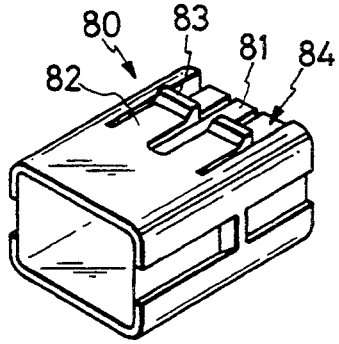
FIG. 11 is a perspective view of a modification of the connector housing of the first embodiment.

In a connector housing 80 shown in FIG. 11, two plate-like portions 82 extend in spaced relation to outer surfaces of non-deformable portions 81. Two pawls (not shown) for respectively retainingly engaging retaining portions of metal terminals (not shown in FIG. 11) are formed on each of the plate-like portions 82, and an engagement projection or ridge 83 is formed on each plate-like portion 82. This construction constitutes a resilient retaining portion 84.

Figure 12:
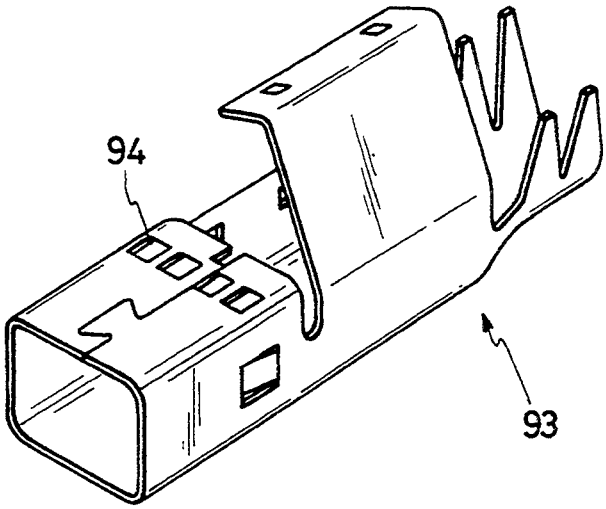
FIG. 12 is a perspective view of a shield cover of a second embodiment.
Figure 13:
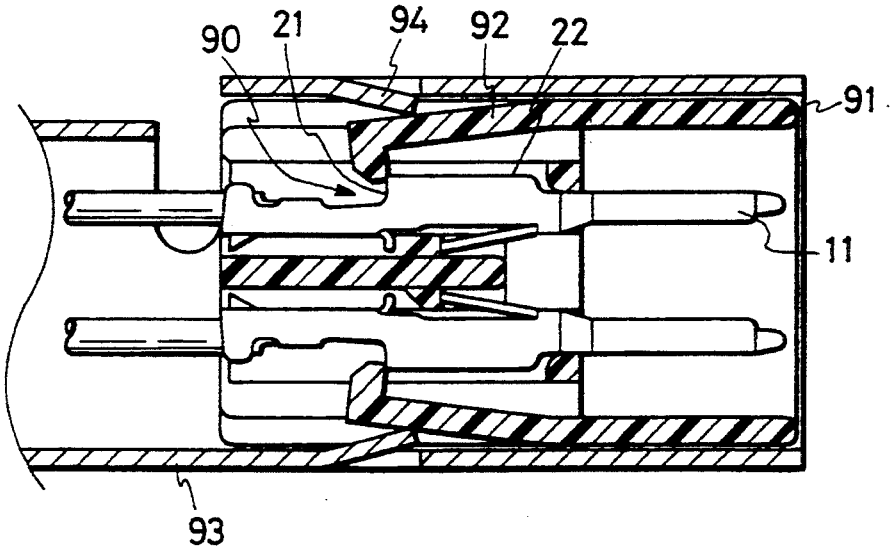
FIG. 13 is a cross-sectional view showing a condition in which the shield cover is attached to a connector housing in the second embodiment.

Next, a second embodiment of the present invention will now be described with reference to FIGS. 12 and 13.

With respect to a second retaining means 90 in this embodiment, an engagement projection is not provided on a distal end of a resilient retaining portion 92 of a connector housing 91, and the resilient retaining portion 92, when in its free condition, lies flush with an outer surface of the connector housing 91. A shield cover 93 has urging pieces 94 that are formed by stamping and raising part of the shield cover, the urging piece 94 being directed obliquely inwardly and forwardly. When the connector housing 91 is connected to the shield cover, the urging piece 94 urges the resilient retaining portion 92 from the outer side.

When a metal terminal 11 is inserted into a predetermined position, the resilient retaining portion 92 of the connector housing 91 is urged by the urging piece 94 of the shield cover 93, and therefore, portion 92 is resiliently deformed inwardly to retainingly engage a retaining portion 21 of the metal terminal 11, thereby preventing the movement of the metal terminal 11 in a withdrawing direction. When the metal terminal 11 is not inserted into the predetermined position, the resilient retaining portion 92 urged by the urging piece 94 engages an engagement portion 22 of the metal terminal 11 and is prevented from further deformation, and therefore an incomplete insertion of the metal terminal 11 can be detected.

Figure 14:
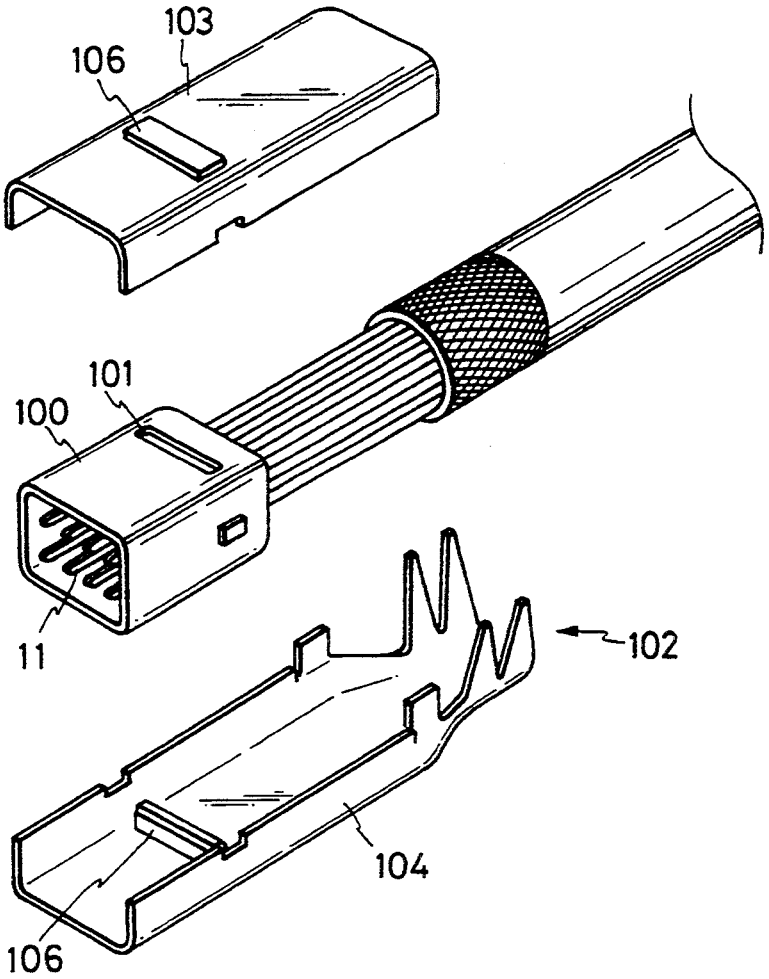
FIG. 14 is an exploded perspective view of a third embodiment.

A third embodiment of the present invention will now be described with reference to FIGS. 14 to 16.

In this embodiment, a slit 101 extending transversely across connector housing 100 is formed in each of upper and lower surfaces of a connector housing 100, and slit 101 is disposed generally in registry with a retaining portion 21 of a metal terminal 11 inserted into a predetermined position.

A shield cover 102 includes an upper cover member 103 and a lower cover member 104, and press-fitting holes 103*a* and 104*a* corresponding respectively to the slits 101 are formed respectively in the upper and lower cover members 103 and 104. A projection retaining pawl 106 serving as a second retaining means is fixedly press-fitted in each of press-fitting holes 103*a*, 104*a* so as to project into the shield cover 102. The projection retaining pawl 106 is made of a resin, so that it has insulative properties.

Figure 15:
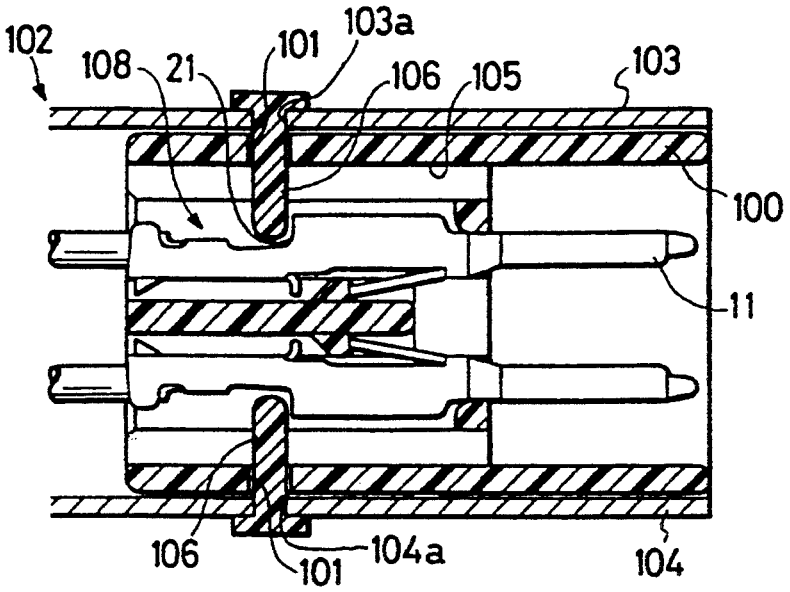
FIG. 15 is a cross-sectional view showing a condition in which metal terminals inserted into respective predetermined positions are prevented from withdrawal in the third embodiment.

In this embodiment, the metal terminal 11 is inserted into the predetermined position, and in this condition, when the shield cover 102 is fitted on the connector housing 100, the projection retaining pawls 106 of the shield cover 102 engage the retaining portions 21 of the metal terminals 11, as shown in FIG. 15, thereby preventing the movement of the metal terminals in a withdrawing direction.

Figure 16:
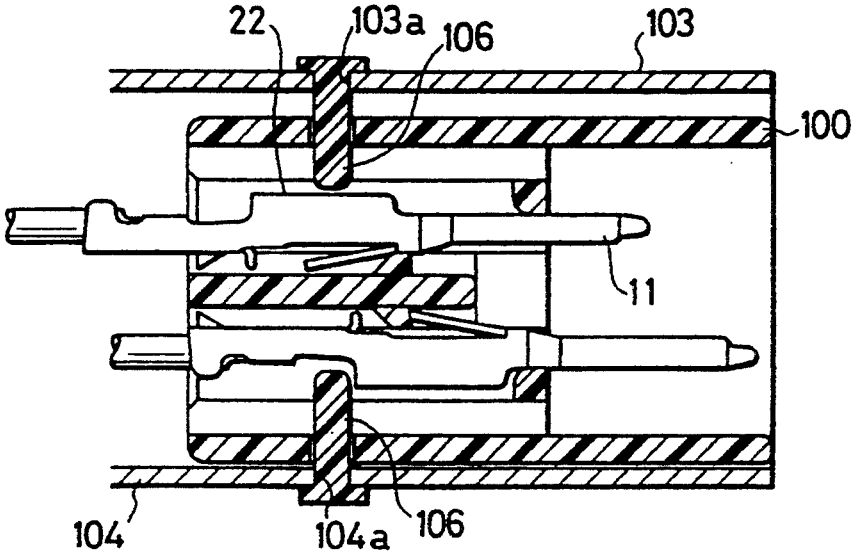
FIG. 16 is a cross-sectional view showing a condition in which the fact that the metal terminal has not been inserted into the predetermined position is detected when a shield cover is to be attached to a connector housing in the third embodiment.

When trying to fit the shield cover 102 in a condition in which the metal terminal 11 is not fully inserted into the predetermined position, the projection retaining pawl 106 engages an engagement portion 22 of the metal terminal 11 as shown in FIG. 16, and therefore the cover member 103 or 104 having this projection retaining pawl 106 cannot be brought into intimate contact with the outer surface of the connector housing 100, and the two cover members 103 and 104 cannot be mated together. Thus, an incomplete insertion of the metal terminal 11 can be detected.

In any of the above embodiments, when the metal terminal is inserted into the predetermined position within the terminal receiving chamber of the connector housing, the first retaining device functions to prevent the movement of the metal terminal in the withdrawing direction. When the shield cover is fitted on the connector housing, the second retaining device performs its function to engage the metal terminal if the metal terminal is inserted into the predetermined position, thereby preventing the movement of the metal terminal in the withdrawing direction, thus achieving a so-called double lock condition.

The second retaining device can be brought into engagement with the metal terminal upon fitting of the shield cover if the metal terminal is disposed in the predetermined position. If the metal terminal is not inserted into the predetermined position, the second retaining device is not engaged with the metal terminal, and therefore this improper engagement can be perceived when the shield cover is fitted, so that the operator immediately recognizes an incomplete insertion of the metal terminal.

Thus, in the shield connectors of the present invention, the withdrawal of the metal terminal is prevented in a double manner by the first retaining device and the second retaining device, and therefore the withdrawal of the metal terminal can be prevented positively. As the second retaining device performs its function, utilizing the originally-provided shield cover, a special withdrawal prevention part such as a retainer is not necessary, and the number of component parts is not increased. Moreover, when the metal terminal is in an incompletely-inserted condition, this can be perceived when fitting the shield cover.

The present invention is not limited to the embodiments described above and shown in the drawings, and for example, the following additional modifications are possible.

(1) In the above embodiments, although the number of the metal terminals 11 of the shield wire 10 is 8, the number can be any desired number.

(2) In the above embodiments, the first retaining means is constituted by the resilient retaining piece, formed on the metal terminal, and the retaining projection formed on the connector housing; however, in contrast, a retaining projection may be formed on the metal terminal, whereas a resilient retaining piece is formed on the connector housing.

While the embodiments disclosed are preferred, it will be appreciated from this teaching that various alternatives, modifications, variations or improvements therein may be made by those skilled in the art that are within the scope of the invention, which is defined by the following claims.

What is claimed is:

1. A shield connector including an insulative connector housing having terminal receiving chambers into which metal terminals connected respectively to core wires of a shield wire are inserted, respectively, and an electrically-conductive shield cover fitted on said connector housing, the shield connector comprising:

first retaining means engaging the metal terminal upon insertion of the metal terminal into a predetermined position within said terminal receiving chamber, for preventing the movement of the metal terminal in a withdrawing direction; and second retaining means engaging the metal terminal when the metal terminal reaches said predetermined position, for preventing the movement of the metal terminal in the withdrawing direction when said second retaining means engages the metal terminal, said second retaining means engaging said metal terminal when said shield cover is fitted on said connector housing.

2. A shield connector according to claim 1, wherein said second retaining means comprises a resilient retaining portion resiliently mounted on said connector housing, said resilient retaining portion being deformable by said shield cover into engagement with the metal terminal inserted into said predetermined position when said shield cover is fitted on said connector housing.

3. A shield connector according to claim 1, wherein said second retaining means comprises a retaining portion mounted on said shield cover, said retaining portion being engageable with the metal terminal inserted into said predetermined position when said shield cover is fitted on said connector housing.

4. A shield connector according to claim 1, wherein said first retaining means comprises a resilient retaining piece extending obliquely in a direction opposite from an insertion direction of said metal terminals, said resilient retaining piece engagable with a retaining projection in a corresponding one of said terminal receiving chambers.

5. A shield connector according to claim 4, wherein said second retaining means comprises a second connecting device comprising a resilient retaining pawl partially extending into a corresponding one of said terminal receiving chambers, said resilient retaining pawl engagable with a retaining portion of a corresponding one of said metal terminals.

6. A shield connector according to claim 4, wherein said second retaining means comprises an urging piece extending obliquely inwardly from said shield cover and in the insertion direction, said urging piece engagable with a resilient retaining ridge member in said connector housing, said resilient retaining ridge member engagable with a retaining portion of a corresponding one of said metal terminals.

7. A shield connector according to claim 4, wherein said second retaining means comprises a projection retaining pawl extendible through a slit in said connector housing and a corresponding press-fitting hole in said shield cover, said projection retaining pawl engagable with a retaining portion of a corresponding one of said metal terminals.

8. A shield connector including an insulative connector housing and an electrically-conductive shield cover fitted on said connector housing, said connector housing having terminal receiving chambers into which metal terminals connected respectively to core wires of a shield wire are adapted to be inserted, respectively, said shield connector comprising:

a first connecting device comprising a resilient retaining piece extending obliquely in a direction opposite from an insertion direction of said metal terminals, said resilient retaining piece engagable with a retaining projection in a corresponding one of said terminal receiving chambers; and a second connecting device comprising a resilient retaining pawl partially extending into a corresponding one of said terminal receiving chambers, said resilient retaining pawl engaging a retaining portion of a corresponding one of said metal terminals when said metal terminals have been inserted into said terminal receiving chambers and said shield cover is fitted on said connector housing.

9. A shield connector according to claim 8, wherein a respective said resilient retaining piece extends from each of said metal terminals.

10. A shield connector according to claim 8, wherein when each of said metal terminals is inserted to a predetermined position in a corresponding one of said terminal receiving chambers, said resilient retaining piece engages said retaining projection in said corresponding one of said terminal receiving chambers and said resilient retaining pawl engages said retaining portion of said corresponding one of said metal terminals, wherein when said metal terminals are not in said predetermined position, said resilient retaining pawl engages an engagement portion of a corresponding one of said metal terminals, thereby preventing said electrically-conductive shield cover from being fitted on said connector housing.

11. A shield connector according to claim 8, wherein said shield connector comprises four of said resilient retaining pawls on each of an upper side and a lower side of said connector housing.

12. A shield connector according to claim 11, wherein a projection is fixed to outer surfaces of distal ends of said resilient retaining pawls transversely connecting said four resilient retaining pawls on each of said upper and said lower surfaces.

13. A shield connector according to claim 11, wherein a projection is fixed to outer surfaces of distal ends of said resilient retaining pawls, each of said projections transversely connecting two adjacent ones of said four resilient retaining pawls on each of said upper and said lower surfaces.

14. A shield connector according to claim 11, wherein a plate-like portion extends in spaced relation to outer surfaces of three non-deformable portions on each of said upper side and said lower side of said connector housing, each of said plate-like portions comprising an elongate ridge on an outer surface and at a distal end of said plate-like portions.

15. A shield connector according to claim 11, wherein two plate-like portions extend in spaced relation to outer surfaces of three non-deformable portions on each of said upper side and said lower side of said connector housing, each of said plate-like portions comprising an elongate ridge on an outer surface and at a distal end of said plate-like portions.

* * * * *